US005350309A

United States Patent [19]

Abukawa et al.

[11] Patent Number: 5,350,309

[45] Date of Patent: Sep. 27, 1994

[54] CONNECTOR WITH A PROTECTIVE COVER

[75] Inventors: Yukihiro Abukawa, Kanagawa; Hiraji Takase; Yasuhisa Shinji, both of Shizuoka, all of Japan

[73] Assignees: Yazaki Corporation; Isuzu Motors Limited, both of Tokyo, Japan

[21] Appl. No.: 35,924

[22] Filed: Mar. 23, 1993

[30] Foreign Application Priority Data

Mar. 24, 1992 [JP] Japan ..... 4-015340

[51] Int. Cl.[5] ..... H01R 13/44

[52] U.S. Cl. ..... 439/138; 439/595

[58] Field of Search ..... 439/142, 138, 595, 140, 439/596, 67, 77

[56] References Cited

U.S. PATENT DOCUMENTS

| | | | |
|---|---|---|---|
| 3,716,815 | 2/1973 | Riches | 439/142 |
| 3,943,325 | 3/1976 | Pickard | 439/142 |
| 4,415,044 | 11/1983 | Davis | 439/142 |
| 4,936,792 | 6/1990 | Onoue et al. | 439/329 |
| 4,941,839 | 7/1990 | Nagasaka et al. | 439/352 |
| 5,106,326 | 4/1992 | Tsuji et al. | 439/596 |
| 5,141,452 | 8/1992 | Yoneda et al. | 439/595 |
| 5,232,373 | 8/1993 | Sawada | 439/595 |

FOREIGN PATENT DOCUMENTS

| | | |
|---|---|---|
| 4108128A1 | 9/1991 | Fed. Rep. of Germany . |
| 53-163583 | 12/1978 | Japan . |

*Primary Examiner*—Larry I. Schwartz
*Assistant Examiner*—Hien D. Vu
*Attorney, Agent, or Firm*—Finnegan, Henderson, Farabow, Garrett & Dunner

[57] ABSTRACT

A connector with a protective cover for exposed electrical terminals. The connector includes a housing having an opening formed on one side thereof through which electrical contacts of terminals are exposed. The protective cover includes an insulating protector for covering the opening of the connector and a housing holder detachably assembled to the housing. The insulating protector has a protective plate and two arms extending in the same direction from the longitudinal ends of the protective plate. Each of the arms has a projection and is rotatably assembled at distal end thereof to the housing holder. The housing holder has a closing-position locking groove and an opening-position locking groove, which are provided about rotating axis of the arms and angularly spaced apart from each other. The protective plate closes the opening of the connector A when the projection is received in the closing-position locking groove, and opens the opening when the projection is received in the opening-position locking groove.

12 Claims, 6 Drawing Sheets

CONNECTOR WITH A PROTECTIVE COVER

BACKGROUND OF THE INVENTION

1. Field of the Invention

The present invention relates to a direct insertion type connector with a protective cover, which connector is fitted into an electrical circuit fabricated on a FPC in an electric apparatus such as a meter case for an automotive vehicle.

2. Prior Art

FIG. 5 is a perspective view of a conventional direct insertion type connector a. A housing 21 made of a synthetic resin is provided with an opening 22 on one side wall thereof through which resilient contacts 24 of terminals 23 are closed. A locking arm 25 (FIG. 4B) includes a projection 25*a*. FIG. 6 shows a cross section of the connector a in FIG. 5 when the connector a is fully fitted into a recess 27 of a meter case b. An FPC 28 is provided on the inner wall of the recess 27. When the connector a is fully inserted into the recess 27, the resilient contacts 24 become in contact with contacts 20 of the FPC 28 to make electrical contact. At this time, the locking arm 25 of the connector a engages a hook 30 on the inner wall of the recess 27, so that the connector a is locked in place. The connector a is inserted into a protective cover c as shown in FIG. 7 until the connector a is inserted into a mating case b as shown in FIG. 8, so that the electrical contacts 24 are protected from soiling and accidental contact with other electrically conductive elements. The protective cover c is disposable and therefore put aside after mounting the connector a into the meter case b. If the connector a is drawn at a later time from the meter case for inspection, the terminals 23 are exposed as shown in FIG. 5. This is dangerous because the contacts 24 may inadvertently contact the vehicle body or the metallic panel to cause short-circuit or mechanical damages to the terminals. Of course, the workman should follow the safety instructions, for example, disconnecting the battery from the electrical circuit when carrying out maintenance operations. If, however, the workman fails to follow such instructions, the connector a with the aforementioned construction is in potential danger.

FIG. 9 shows another conventional direct insertion type connector a′ disclosed in Japanese Utility Model Preliminary Publication No. 53-163585. In FIG. 9, a housing 21′ is provided with an opening 22′ on each of the opposed sides of a front half thereof. Resilient contacts 24′ of terminals 23′ are exposed through the openings 21′. The opening 22′ is provided with a cover 31. The cover 31 includes a locking latch 32 that serves to lock the connector a′ to the meter case when inserted into the meter case. This construction necessitates a mating engagement on the meter case with which the locking latch 32 is engaged. Further, providing the mating engagement on the meter case places limitations on the FPC layout and therefore results in a larger meter case.

SUMMARY OF THE INVENTION

An object of the present invention is to provide a connector with an attached protective cover where the connector may be mounted to a meter case and the protective cover protects the connector from damage when disconnected from the meter case.

The connector includes a housing having an opening formed on one side thereof through which electrical contacts of terminals are exposed. The protective cover includes an insulating protector for covering the opening of the connector and a housing holder detachably assembled to the housing. The insulating protector has a protective plate and two arms extending in the same direction from the longitudinal ends of the protective plate. Each of the arms has a projection and is rotatably assembled at distal end thereof to the housing holder. The housing holder has a closed-position locking groove and an opened-position locking groove, which are provided about rotating axis of the arms and angularly spaced apart from each other. The protective plate closes the opening of the connector A when the projection is received in the closed-position locking groove, and opens the opening when the projection is received in the opened-position locking groove.

BRIEF DESCRIPTION OF THE DRAWINGS

Features and other objects of the present invention will become more apparent from the detailed description of the preferred embodiments with reference to the drawings in which.

DETAILED DESCRIPTION OF THE PREFERRED EMBODIMENTS

Construction

Figure 1A:
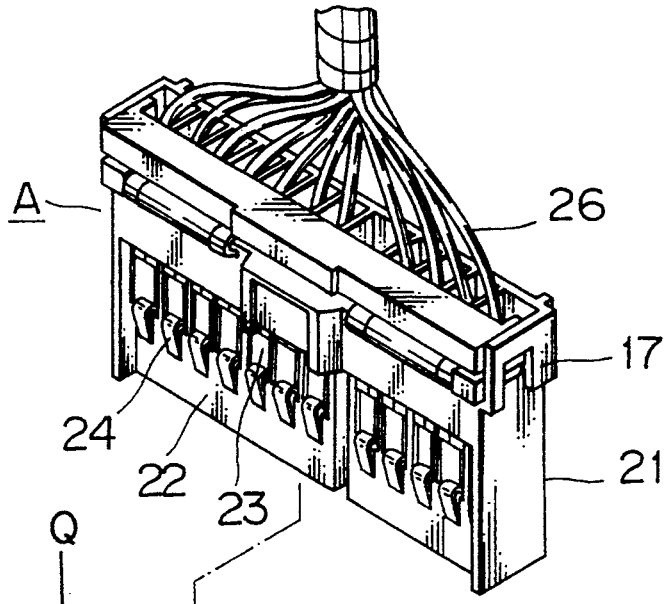
FIGS. 1A and 1B are perspective views of a connector and a protective cover therefore according to the present invention.
Figure 2:
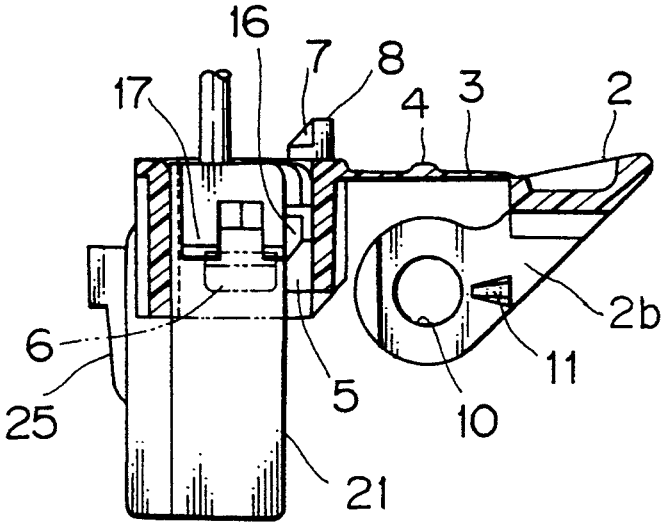
FIG. 2 is a side view of the connector of FIGS. 1A–1B with the protective cover assembled to the connector, showing a cross section in part.
Figure 3:
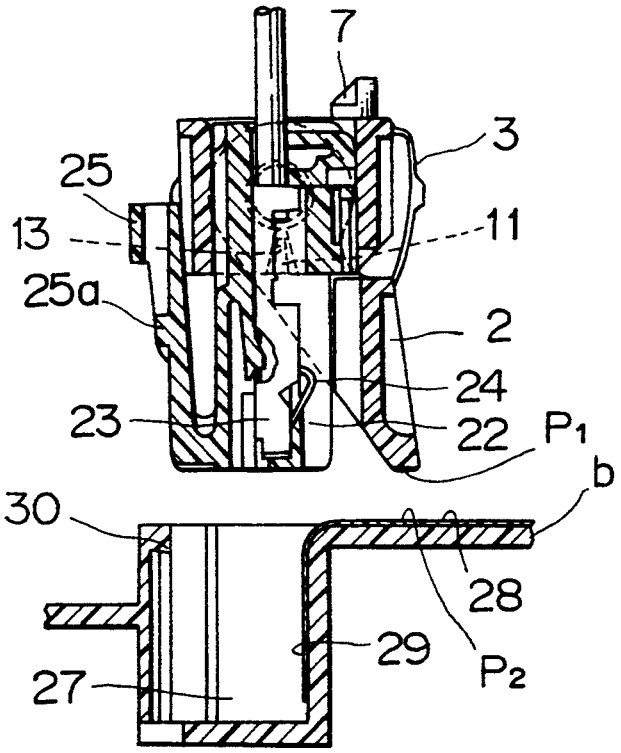
FIG. 3 is a cross-sectional view of the connector and the meter case immediately before the connector is inserted into the meter case.

FIG. 1A is a perspective view of a connector A. The connector A has a housing 21 having an opening 22 on one of opposed side walls and a locking arm 25 (FIG. 2) with a projection 25*a* (FIG. 3) on the other. The housing 21 houses terminals 23 crimped to wires 26. Resilient electrical contacts 24 of the terminals 23 are exposed through the opening 22 provided on one of the opposed side walls of the housing. The housing 21 is also provided with recesses 17 which engage projections 6 of the connector cover B. FIG. 1A shows one of the engaging recesses 17.

Figure 1B:
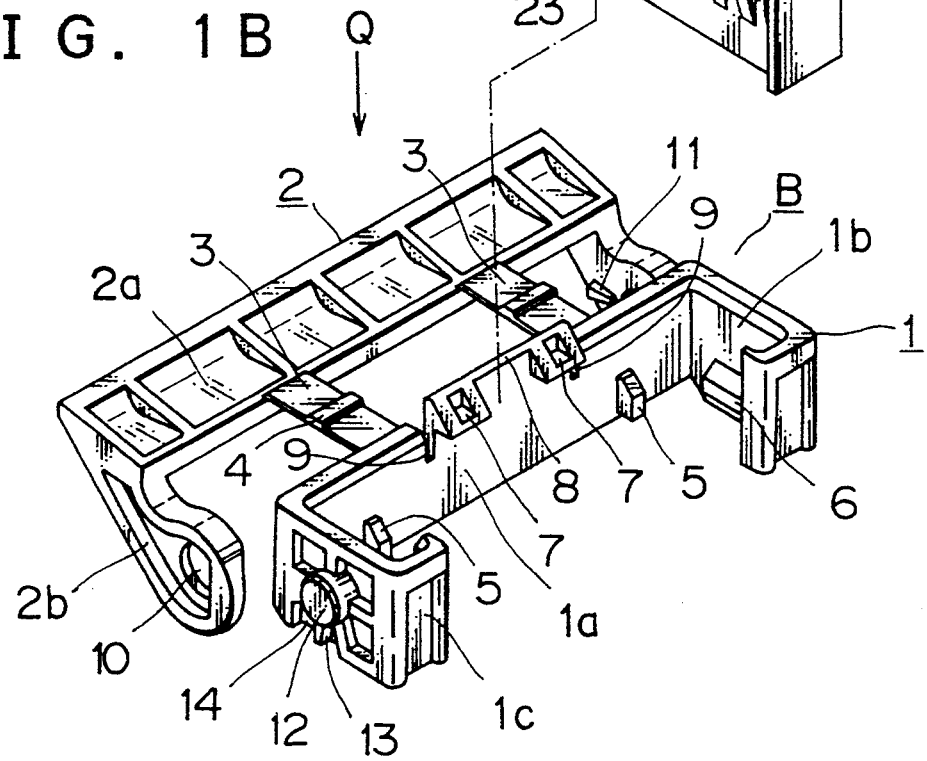
Figure 4A:
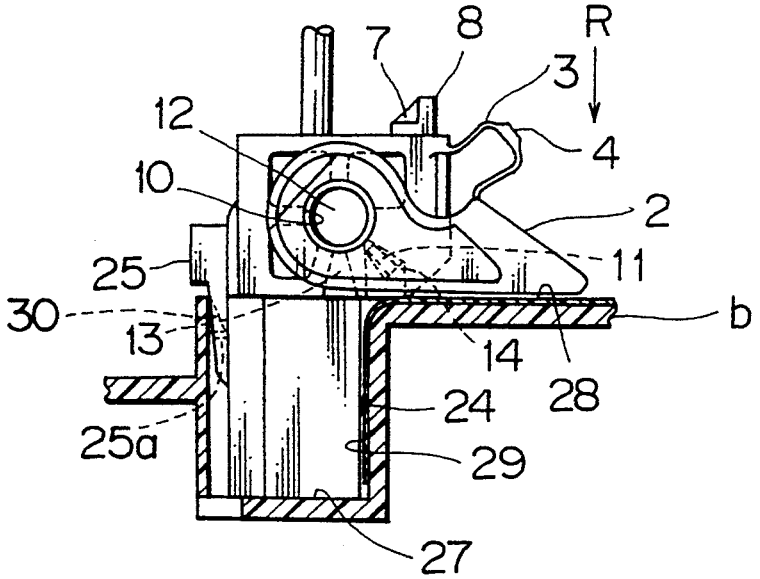
FIG. 4A shows the connector of FIG. 3 after the connector has been inserted into the meter case.
Figure 4B:
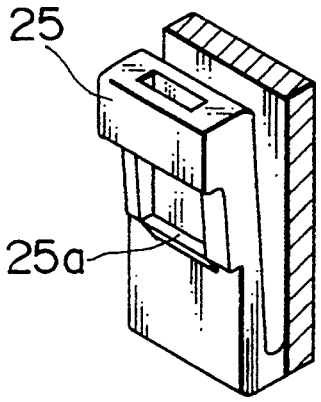
FIG. 4B shows the detail of a locking arm 25 and a projection 25*a;*
Figure 4C:
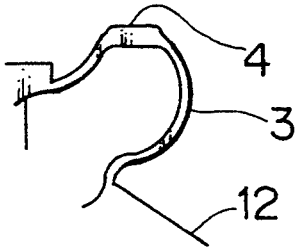
FIGS. 4C–4D show the different positions of a thick portion 4 on a hinge 3.
Figure 4D:
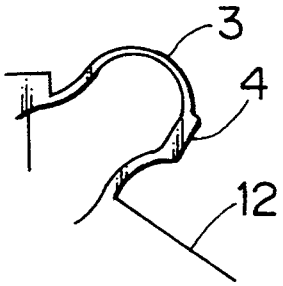
Figure 5:
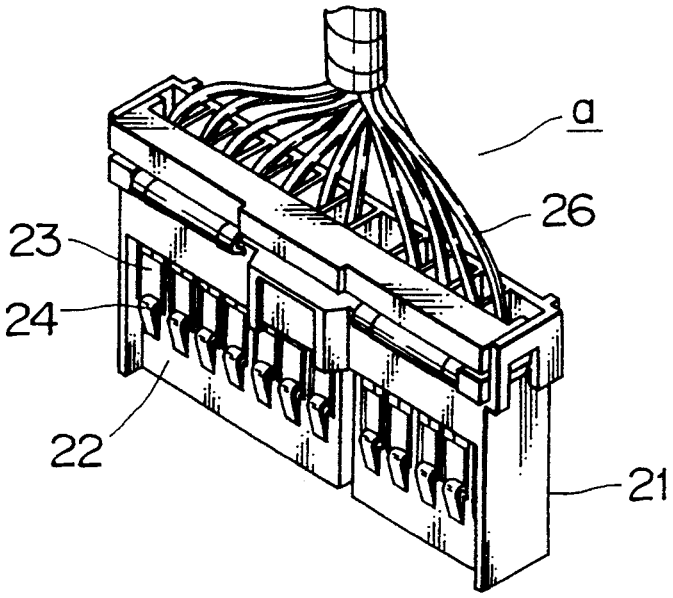
FIG. 5 PRIOR ART
FIG. 5 is a perspective view of a conventional director insertion type connector.
Figure 6:
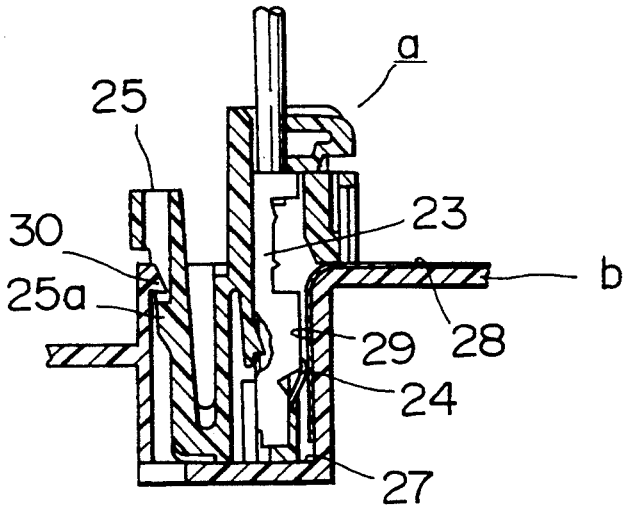
FIG. 6 PRIOR ART
FIG. 6 is a cross-sectional view of the connector of FIG. 5 fitted into the meter case.
Figure 7:
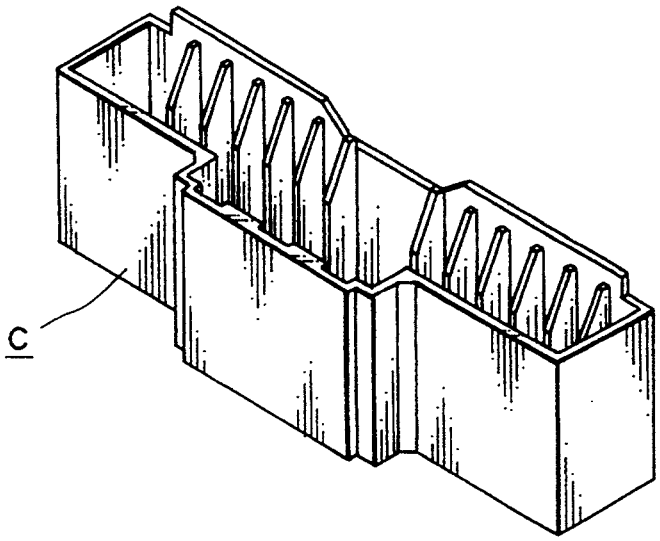
FIG. 7 PRIOR ART
FIG. 7 is a perspective view of a protective cover for a conventional connector.
Figure 8:
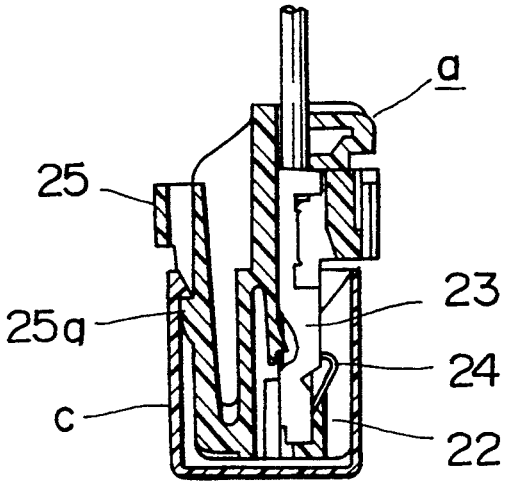
FIG. 8 PRIOR ART
FIG. 8 is a cross-sectional view of the connector of FIG. 7 when fitted to the protective cover of FIG. 7.
Figure 9:
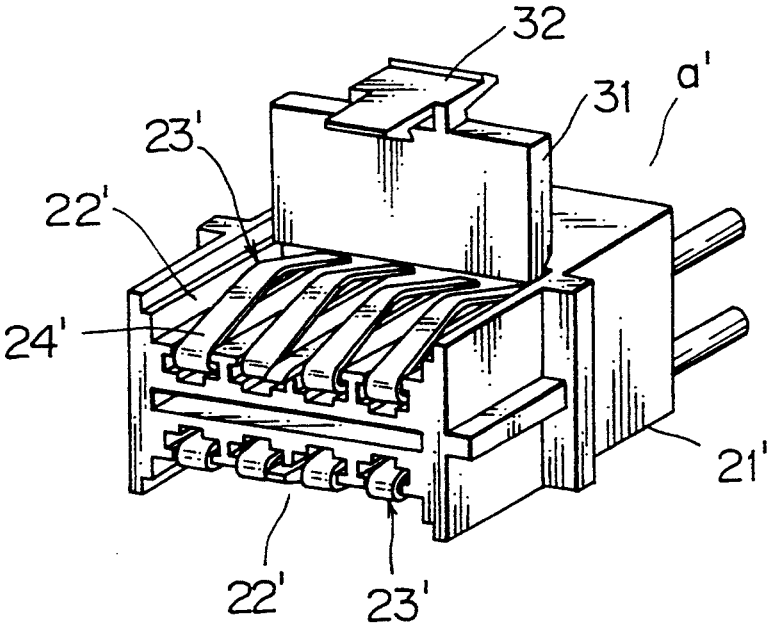
FIG. 9 PRIOR ART
FIG. 9 is a perspective view of another conventional direct insertion type connector.

FIG. 1B is a perspective view of a protective cover made of a synthetic resin. The protective cover B includes an insulating protector 2 and a housing holder 1 which is mounted on the upper half portion of the housing 21 of the connector A. The housing holder 1 is integrally continuous with the insulating protector 2 via a hinge 3 having a thick portion 4 theft defines a desired curved shape of hinge 3 after connector A is assembled to the circuit. FIGS. 4C–4D show different positions of the thick portion 4 on the hinge 3. The housing holder 1 is a generally U-shaped frame having a longitudinal side wall 1*a* and short walls 1*b* at each of longitudinal ends of the side wall 1*a*. The short walls 1*b* each have a hook 1*c* at a free end thereof and a shaft 12 projecting outwardly from the short walls 1*b*. Each hook 1*c* has a tip end extending toward the longitudinal side wall 1*a* as shown in FIG. 1B. Below the shaft 12 are formed radially extending grooves 13 and 14 which are angularly spaced. The groove 13 serves as a closed-position locking groove while the groove 14 serves as an opened-position locking groove. At the lower ends of the longitudinal wall 1*a* and short walls 1*b* are provided with projections 5 and 6, respectively. The longitudinal side wall 1*a* is formed with two parallel slits 9 therein as shown in FIG. 1B. Parallel slits 9 define a resilient lock arm 8 therebetween for latching the housing of the connector A when the connector A is assembled to the protective cover B. The insulating protector 2 includes a protective plate 2*a* and two arms 2*b* formed on the longitudinal ends of the protective plate 2*a*. The two arms 2*b* extend transversely of the protective plate 2*a* in the same direction. The two arms 2*b* are assembled to the housing holder 1 such that the shaft 12 projecting outwardly from the walls 1*b* extends through holes 10 in the arms 2*b*. Thus, the two arms 2*b* become rotatable about the shaft 12. As shown in FIG. 1B, the arms 2*b* each have a projection 11 which drops into the closed-position locking groove 13 or into the opened-position locking groove 14 in a locking relation when rotated about the shaft 12. The closed-position locking groove 13 receives the projection 11 so that the protective plate 2*a* is positioned to close the opening 22 of the connector A when the connector A is not inserted into the meter case, The opened-position locking groove 14 receives the projection 11 so that the protective plate 2*a* is positioned to uncover the opening upon insertion of the connector A into the meter case.

Operation

As shown in FIGS. 1A and 1B, the connector A is inserted into the housing holder 1 in the direction of arrow Q with the opening 22 facing the resilient lock arm 8 of the housing holder 1. When the connector A is further inserted into the housing holder 1, the upper edge of the housing 21 cams the projections 7 of the resilient lock arm 8 laterally out of the way so that the resilient lock arm 8 yieldably deflects. The resilient arm 8 returns to its normal position after the connector A has been fully inserted into the housing holder 1. At this time, the recesses 16 and 17 abut the projections 5 and 6 of the housing holder 1 and the projections latch the housing 21 so that the connector A fits the housing holder 1 in a locking relation.

Then, the arms 2*b* are journaled to the shafts 12 of the housing holder 1. Rotating the arms 2*b* toward the connector A causes the projection 11 to drop into the locking groove 13, so that the protective plate 2*a* covers the opening 22 with the arms 2*b* locked in the groove 13. In this manner, the protective plate 2*a* isolates the resilient electrical contacts 24 of the terminals 23 from the outside.

When the thus assembled connector A with the protective cover B is plugged into the recess 27 in the meter case b, a tip end P1 (FIG. 3) of the arm 2*b* abuts a surface P2 of the meter case b to produce an upward moment which releases the projection 11 from a locking relation with the locking groove 13. At this time, the insulating protector 2 rotates to open the opening 22. A further insertion of the connector A into the recess 27 accomplishes electrical contact between the resilient electrical contacts 24 of the connector A and terminals 29 of an FPC 28. Then, the projection 25*a* of the connector A engages the portion 30 of the recess 27 in a locking relation. FIG. 4B shows the detail of the locking arm 25 and the projection 25*a*. Meanwhile, the projection 11 engages the opened-position locking groove 14 so that the insulating protector 2 is locked in place.

When the thus inserted connector A is disconnected from the meter case for maintenance purpose, the insulating protector can be returned manually to its home position.

Since the insulating protector 2 is locked in place, there is little or no chance for the insulating protector to rattle while the vehicle is cruising. The repelling force of the hinge 3 urges the insulating protector 2 in the direction of arrow R against the meter case b, further preventing the insulating protector 2 from rattling.

Although the embodiment has been described with respect to the protective cover B having the housing holder 1 integrally continuous with the insulating protector 2 via the hinges 3, the hinges 3 may be omitted. The shafts 12 may be provided on the arms 2*b* and the holes 10 may be provided in the housing holder 1. A plurality of opened-position locking grooves 14 may be provided at different angular positions taking into account the opening angles of the protective plate 2*a* as well as different fitting depth between the connector A and the meter case b.

What is claimed is:

1. A connector assembly for use in an electrical circuit of a case, comprising:
   - a connector having a housing with an opening formed on one side thereof through which an electrical contact projects from said housing; and
   - a protective cover comprising:
     - a housing holder detachably assembled to said housing of the connector;
     - an insulating protector for covering the opening of the connector, said insulating protector having a protective plate and arms extending from opposite ends of said protective plate, said arms being assembled at distal end portions thereof to said housing holder such that said arms are rotatable about a rotating axis; and
   - a locking means for locking said arms at a first position when said protective plate covers said opening to protect said electrical contacts until said connector is inserted into said case to engage with the electrical circuit, and at a second position when said protective plate uncovers said opening to permit the connector to be inserted into said case to engage with the electrical circuit.

2. The connector assembly according to claim 1, wherein said locking means includes:
   - a first groove for said first position and a second groove for said second position, said first and second grooves being provided on said housing holder about said rotating axis and angularly spaced apart from each other, and a first projection provided on said arm, wherein said first projection engaging said first groove when said protective plate covers said opening and engaging said second groove when said protective plate uncovers said opening.

3. The connector assembly according to claim 1, wherein said protective cover is made of a synthetic resin.

4. The connector assembly according to claim 3, wherein said protective cover includes a resilient hinge via which said housing holder is integrally continuous with said insulating protector, said resilient hinge preventing said arms from rattling after said arms have been assembled to said housing holder.

5. The connector assembly according to claim 4, wherein said hinge further includes a portion for defining a desired curved shape of hinge after connector A is assembled to a mating circuit.

6. The connector assembly according to claim 1, wherein said connector further includes a recess and said housing holder further includes a locking arm and a second projection, said second projection engaging said recess when said connector is assembled to said housing holder and said locking arm engaging said housing of the connector to that the connector is held by said housing holder in a locking relation.

7. A protective cover for use with a connector having a housing with an opening formed on one side thereof through which en electrical contact projects from said housing, said protective cover comprising:

a housing holder for detachable assembly to the housing of the connector;

an insulating protector for covering the opening of the connector, said insulating protector having a protective plate and arms extending from opposite ends of said protective plate, said arms being assembled at distal end portions thereof to said housing holder such that said arms are rotatable about a rotating axis; and a locking means for locking said arms at a first position when said protective plate covers said opening to protect said electrical contacts until said connector is inserted into a case having an electrical circuit, and at a second position when said protective plate uncovers said opening to permit the connector to be inserted into said case to engage with the electrical circuit.

8. The protective cover according to claim 7, wherein said locking means includes:

a first groove for said first position and a second groove for said second position, said first and second grooves being provided on said housing holder about said rotating axis and angularly spaced apart from each other, and a first projection provided on said arm, wherein said first projection engaging said first groove when said protective plate covers said opening and engaging said second groove when said protective plate uncovers said opening.

9. The protective cover according to claim 7, wherein said protective cover is made of a synthetic resin.

10. The protective cover according to claim 9, further including a resilient hinge connected between said housing holder and said insulating protector, said resilient hinge preventing said arms from rattling after said arms are assembled to said housing holder.

11. The protective cover according to claim 10, wherein said hinge further includes a portion for defining a desired curved shape of hinge after the connector is assembled to the circuit.

12. The protective cover to claim 7, wherein said connector further includes a recess and said housing holder further includes a locking arm and a second projection, said second projection engaging said recess when said connector is assembled to said housing holder and said locking arm engaging said housing of the connector so that the connector is held by said housing holder in a locking relation.

* * * * *